US011317775B2

(12) United States Patent
Okitsu et al.

(10) Patent No.: US 11,317,775 B2
(45) Date of Patent: May 3, 2022

(54) DUST-COLLECTING DEVICE AND VACUUM CLEANER

(71) Applicant: TOSHIBA LIFESTYLE PRODUCTS & SERVICES CORPORATION, Kawasaki (JP)

(72) Inventors: Nobuhide Okitsu, Kanagawa (JP); Akiyoshi Tanaka, Kanagawa (JP); Kiyoshi Ebe, Kanagawa (JP); Fumiki Mano, Kanagawa (JP); Mai Oikawa, Kanagawa (JP); Satoshi Ohshita, Kanagawa (JP)

(73) Assignee: TOSHIBA LIFESTYLE PRODUCTS & SERVICES CORPORATION, Kawasaki (JP)

( * ) Notice: Subject to any disclaimer, the term of this patent is extended or adjusted under 35 U.S.C. 154(b) by 0 days.

(21) Appl. No.: 16/978,908

(22) PCT Filed: Apr. 10, 2019

(86) PCT No.: PCT/JP2019/015689
§ 371 (c)(1),
(2) Date: Sep. 8, 2020

(87) PCT Pub. No.: WO2019/198774
PCT Pub. Date: Oct. 17, 2019

(65) Prior Publication Data

US 2020/0405109 A1 Dec. 31, 2020

(30) Foreign Application Priority Data

Apr. 11, 2018 (JP) ..... JP2018-076466

(51) Int. Cl.
*A47L 9/16* (2006.01)

(52) U.S. Cl.
CPC ..... *A47L 9/1683* (2013.01); *A47L 9/165* (2013.01)

(58) Field of Classification Search
CPC . A47L 9/1608; A47L 5/24; A47L 9/16; A47L 9/165; A47L 9/1616; A47L 9/1625;
(Continued)

(56) References Cited

U.S. PATENT DOCUMENTS

2009/0282791 A1* 11/2009 Lang ..... B04C 5/26 55/326
2017/0296016 A1* 10/2017 Hyun ..... A47L 9/1691
2017/0319031 A1* 11/2017 Hyun ..... A47L 9/1608

FOREIGN PATENT DOCUMENTS

JP 2010-35771 A 2/2010
JP 2010-99381 A 5/2010
JP 2017-158805 A 9/2017

OTHER PUBLICATIONS

International Search Report dated Jun. 4, 2019 in PCT/JP2019/015689 filed on Apr. 10, 2019, 1 page.

* cited by examiner

*Primary Examiner* — Joseph J Hail
*Assistant Examiner* — Timothy Brady
(74) *Attorney, Agent, or Firm* — Oblon, McClelland, Maier & Neustadt, L.L.P.

(57) ABSTRACT

A dust-collecting device includes a cylindrical casing and an insertion part. The casing includes an introduction port introducing dust-containing air. The insertion part is positioned inside the casing to allow a swirling flow of the dust-containing air to be formed between the insertion part and the casing. The insertion part includes a cylindrical side surface part spaced away from and facing the casing and a projection part. The projection part includes, in a side of the first dust-collecting part, a projection surface projecting
(Continued)

outward from the side surface part. The projection surface includes plural straightening parts and a connection part. The straightening parts are formed spirally toward the side of the first dust-collecting part, from upstream to downstream sides of the swirling flow. The connection part connects a downstream end side of one of the straightening parts and an upstream end side of another one of the straightening parts.

10 Claims, 9 Drawing Sheets

(58) Field of Classification Search
CPC .... A47L 9/1633; A47L 9/1658; A47L 9/1666; A47L 9/1675; A47L 9/1683
USPC ..... 15/347, 348, 352, 353; 55/345–349
See application file for complete search history.

DUST-COLLECTING DEVICE AND VACUUM CLEANER

CROSS REFERENCE TO RELATED APPLICATIONS

The present application is a National Stage Application of PCT/JP2019/015689 filed on Apr. 10, 2019. The PCT application acclaims priority to Japanese Patent Application No. 2018-076466 filed on Apr. 11, 2018. All of the above applications are herein incorporated by reference.

FIELD

Embodiments described herein relate generally to a dust-collecting device having a separator configured to centrifugally separate dust and dirt by swirling dust-containing air and a dust-collecting part configured to accumulate the dust and dirt separated by the separator, and a vacuum cleaner including the dust-collecting device.

BACKGROUND

Some conventional dust-collecting devices for use in a vacuum cleaner are configured to centrifugally separate dust and dirt by swirling dust-containing air. Such a dust-collecting device includes a cylindrical casing housing a separator disposed in the upper part thereof and a dust-collecting part disposed in the lower part thereof, and an exhaust pipe disposed inside and coaxially with the casing, and is configured to centrifugally separate dust and dirt by swirling dust-containing air between the inner surface of the casing and the exhaust pipe.

A known dust-collecting device includes, at the boundary between a separator and a dust-collecting part, a shielding member disposed to prevent dust and dirt from being stirred up from the dust-collecting part. A conventional shielding member poorly suppresses dust and dirt from being stirred up from the dust-collecting part, and thus a configuration to suppress such stirring-up is required.

CITATION LIST

Patent Literature

PTL 1: Japanese Laid-open Patent Publication No. 2017-158805

Technical Problem

The present invention aims to provide a dust-collecting device capable of suppressing dust and dirt from being stirred up from a dust-collecting part, and a vacuum cleaner equipped therewith.

Solution to Problem

The dust-collecting device of the present embodiment is equipped with a separator configured to centrifugally separate dust and dirt by swirling dust-containing air, and a dust-collecting part configured to accumulate the dust and dirt separated by the separator. The dust-collecting device includes a cylindrical casing and a structure. The casing has an introduction port allowing dust-containing air to be introduced inside. The structure is positioned inside the casing so as to allow swirling flow of the dust-containing air to be formed between the structure and an inner surface of the casing. The structure has a cylindrical side surface part and a projection part. The side surface part is spaced away from and faces the inner surface of the casing. The projection part includes, in a side of the dust-collecting part, a projection surface projecting outward from the side surface part. The projection surface includes a plurality of straightening parts and a connection part. The straightening parts are formed spirally toward the side of the dust-collecting part, from an upstream side to a downstream side of the swirling flow. The connection part is formed so as to connect a downstream end side of one of the straightening parts and an upstream end side of another one of the straightening parts.

DETAILED DESCRIPTION

First Embodiment

The first embodiment will be described below with reference to FIG. 1 to FIG. 8.

Figure 1:
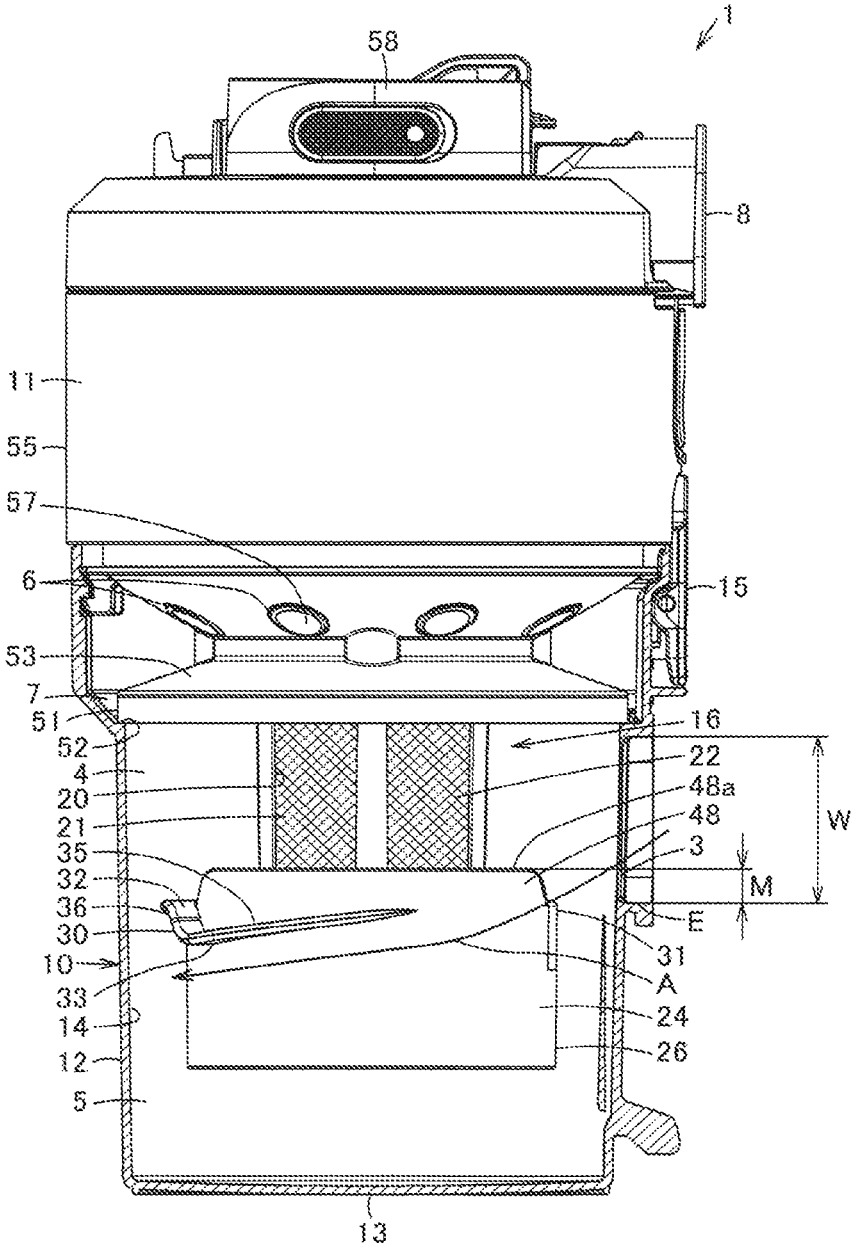
FIG. 1 is a side view illustrating a dust-collecting device of a first embodiment, with its one part cut out.
Figure 2:
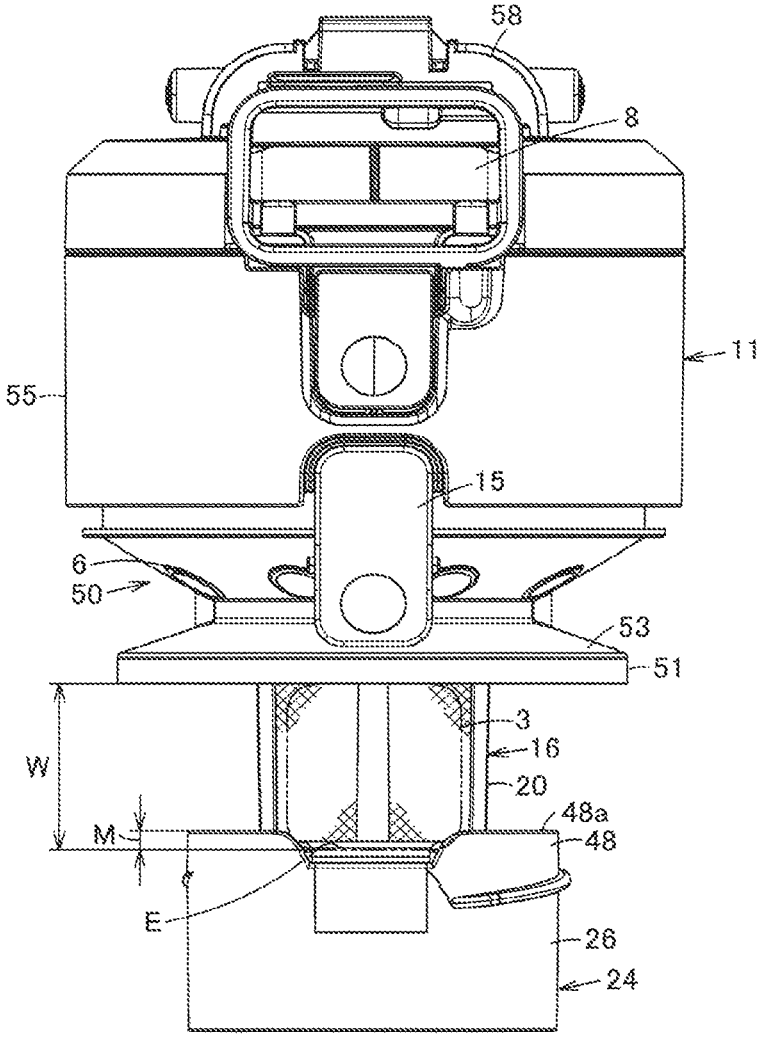
FIG. 2 is a side view partially illustrating the above dust-collecting device.
Figure 3:
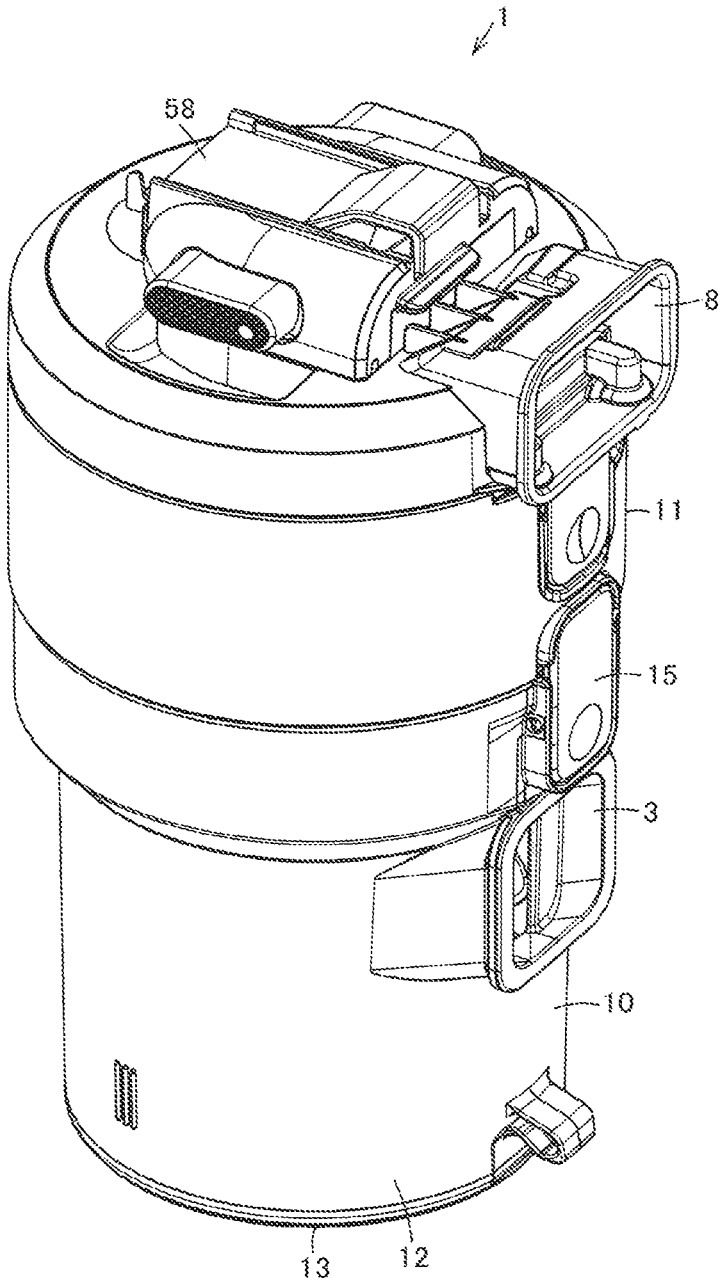
FIG. 3 is an oblique view illustrating the above dust-collecting device.
Figure 4:
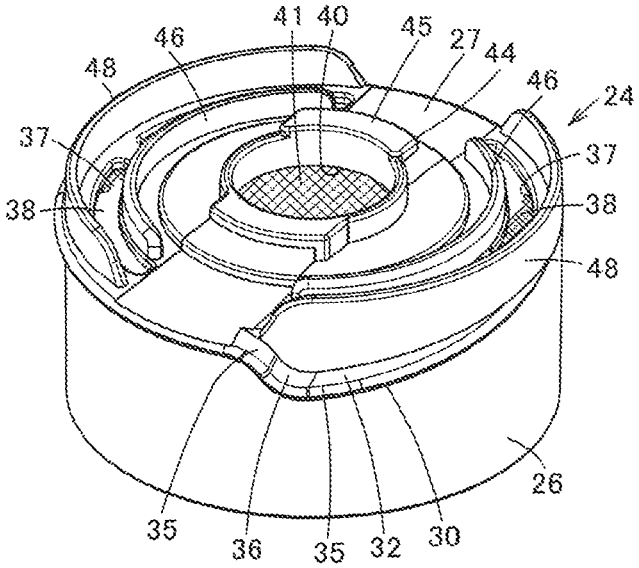
FIG. 4 is an oblique view partially illustrating a structure of the above dust-collecting device.
Figure 5:
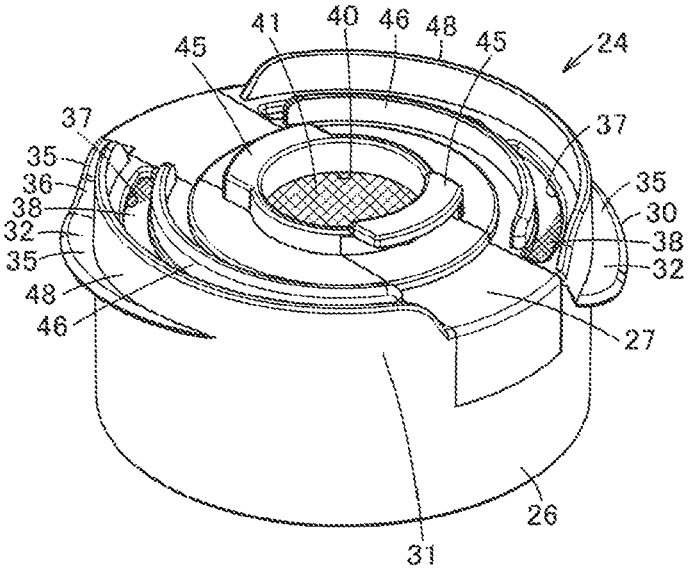
FIG. 5 is an oblique view partially illustrating the structure of the above dust-collecting device, viewed from an opposite direction to the one of FIG. 4.
Figure 6:
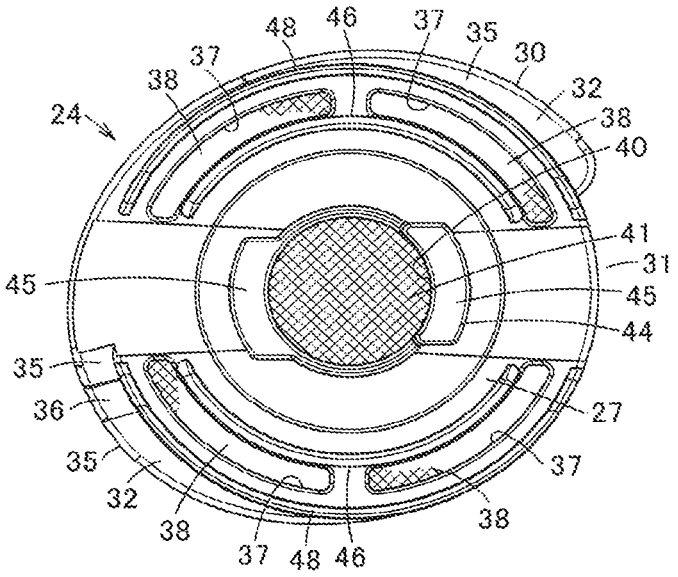
FIG. 6 is a plan view partially illustrating the structure of the above dust-collecting device.
Figure 7:
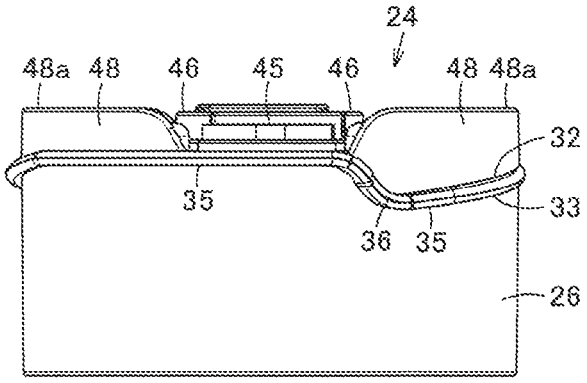
FIG. 7 is a side view partially illustrating the structure of the above dust-collecting device.
Figure 8:
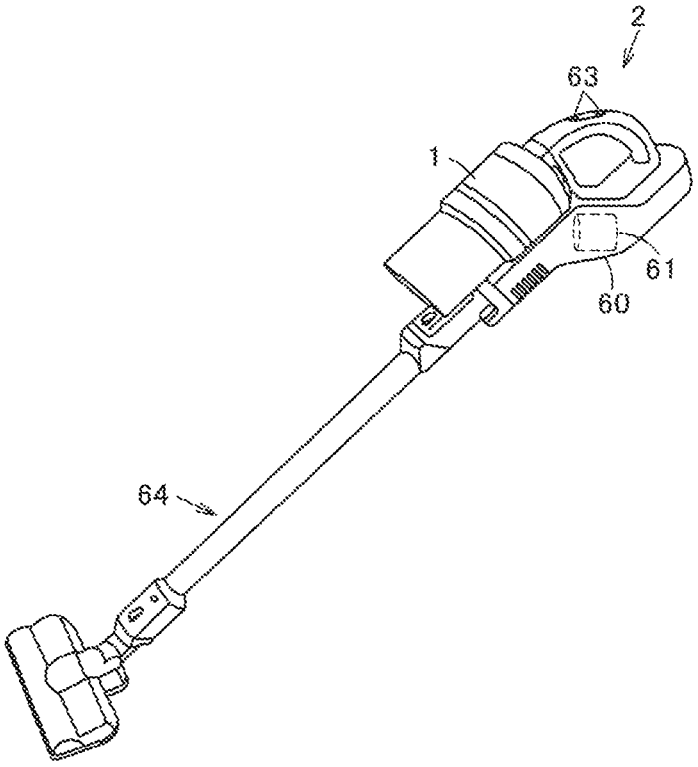
FIG. 8 is an oblique view illustrating a vacuum cleaner including the above dust-collecting device.

In FIG. 1 to FIG. 3, reference sign 1 denotes a dust-collecting device. The dust-collecting device 1 is configured to centrifugally separate and collect dust and dirt from the dust-containing air sucked by a suction source, and is used in a vacuum cleaner 2 to be described later.

The dust-collecting device 1 is a centrifugally-separating-type dust-collecting device configured to centrifugally separate dust and dirt by swirling dust-containing air. The dust-collecting device 1 includes, as air path components, an introduction port 3 through which dust-containing air is introduced, a first centrifuge separator 4 which is a separator configured to centrifugally separate dust and dirt from the dust-containing air introduced through the introduction port 3, a first dust-collecting part 5 which is a dust-collecting part configured to catch and collect the dust and dirt separated by the first centrifuge separator 4, a plurality of second centrifuge separators 6, as an example, which are disposed to further centrifugally separate the remaining dust and dirt which has not been separated by the first centrifuge separator 4, a second dust-collecting part 7 configured to catch and collect the dust and dirt separated by the second centrifuge separators 6, and a discharge port 8 through which the air after separation of dust and dirt is discharged. That is, the dust-collecting device 1 in the present embodiment includes centrifuge separators in multiple steps. The second centrifuge separators 6 or the second dust-collecting part 7 are not essential components.

Moreover, the dust-collecting device 1 structurally includes a casing 10 and a separator 11, and the casing 10 and the separator 11 are attachable and detachable.

The casing 10 is formed of, for example, synthetic resin in a cylindrical shape. In the present embodiment, the casing 10 is formed in a bottomed cylindrical shape. The casing 10 thus includes a cylindrical-shape outer peripheral surface part 12 which is an external surface part, a bottom part 13 covering the end part of the outer peripheral surface part 12, and an inner surface 14 formed in a cylindrical shape, so that one end side, that is, the upper side in FIG. 1 is opened. The casing 10 includes the introduction port 3, so that dust-containing air is introduced through the introduction port 3 to flow along the inner surface 14 of the casing 10, and forms swirling flow. The casing 10 houses the first centrifuge separator 4 in the one end side, that is, in the upper side in FIG. 1, and the first dust-collecting part 5 in the other end side, that is, in the lower side in FIG. 1.

The separator 11 is detachably engaged with the casing 10 by an engaging part 15. The separator 11 includes an insertion part 16 which is a structure positioned inside the casing 10. The swirling flow of dust-containing air is formed between the insertion part 16 and the inner surface 14 of the casing 10. In an example, the insertion part 16 is disposed coaxially or substantially coaxially with the casing 10. Furthermore, the insertion part 16 includes an exhaust pipe 20, which is a cylindrical ventilation part allowing to discharge air from the first centrifuge separator 4. The exhaust pipe 20 is formed in a cylindrical shape. The exhaust pipe 20 includes a ventilation hole 21. For example, a plurality of the ventilation holes 21 are formed on the peripheral surface of the exhaust pipe 20. Moreover, the ventilation holes 21 may be covered with, for example, a discharge filter 22 serving as a filter.

The insertion part 16 further includes a cylindrical enlarged part 24. As shown in FIG. 1, FIG. 2, and FIG. 4 to FIG. 7, the enlarged part 24 forms a boundary between the first centrifuge separator 4 and the first dust-collecting part 5. Also, the enlarged part 24 is positioned in the side of the first dust-collecting part 5 with respect to the exhaust pipe 20. Furthermore, the enlarged part 24 is formed so as to be enlarged more outward than the exhaust pipe 20. That is, the enlarged part 24 is formed so as to have a larger diameter than the exhaust pipe 20. Moreover, the enlarged part 24 is disposed coaxially or substantially coaxially with the exhaust pipe 20. The enlarged part 24 is formed in a cylindrical shape with lid, so as to have an opening in the side of the first dust-collecting part 5, that is, in the facing side to the bottom part 13 of the casing 10. Thus, the enlarged part 24 includes a cylindrical side surface part 26 and a top surface part 27, which is a surface in the side of the exhaust pipe 20.

In the present embodiment, the side surface part 26 is included in the outer peripheral surface of the enlarged part 24. Also, the side surface part 26 is formed in a cylindrical shape so as to extend along the axial direction of the casing 10. The side surface part 26 is spaced away from and faces the inner surface 14 of the casing 10. That is, there is a space between the side surface part 26 and the inner surface 14 of the casing 10. The space is formed narrower than the space between the exhaust pipe 20 and the inner surface 14 of the casing 10. Accordingly, the swirling flow flows faster in the space between the side surface part 26 and the inner surface 14 of the casing 10, compared to in the space between the exhaust pipe 20 and the inner surface 14 of the casing 10. Also, the end part of the side surface part 26 facing the bottom part 13 is spaced away from the bottom part 13. Moreover, the side surface part 26 includes a projection part 30, which is a blade part. The projection part 30 projects outward from the side surface part 26. That is, the projection part 30 projects in the radial direction of the side surface part 26. The outer edge part of the projection part 30 is spaced away from the inner surface 14 of the casing 10. In an example, the projection part 30 is formed continuously in the circumferential direction of the enlarged part 24, and the both end parts thereof are disposed discontinuously so as to be spaced away from each other. That is, in the present embodiment, the projection part 30 includes an intermittent part 31. The projection part 30 further includes a projection surface 32 in the side of the first centrifuge separator 4. Furthermore, in the present embodiment, the projection part 30 is formed in a plate shape including an opposite-side projection surface 33 in the side of the first dust-collecting part 5 which is the opposite side to the projection surface 32.

The intermittent part 31 is formed at a position facing the introduction port 3 in the downstream side of the swirling flow. That is, in the present embodiment, the projection part 30 is formed so as to be discontinuous at the position facing the introduction port 3.

The projection surface 32 projects outward from the side surface part 26. That is, the projection surface 32 is formed so as to project in the radial direction of the enlarged part 24. The projection surface 32 is disposed in the side of the first dust-collecting part 5 with respect to the introduction port 3 at a position facing the introduction port 3. Moreover, the projection surface 32 is disposed so that the upstream end thereof is positioned within a range no greater in length than the half the circumference of the swirling flow in the upstream side with respect to the introduction port 3. The projection surface 32 includes a plurality of straightening parts 35 and a connection part 36 for connecting these straightening parts 35.

Each of the straightening parts 35 is formed spirally toward the first dust-collecting part 5, from the upstream side of the swirling flow of the dust-containing air to the downstream side. Each of the straightening parts 35 is formed so that the upstream end thereof projects from the side surface part 26, gradually outward from the side of the introduction port 3 toward the downstream side of the swirling flow. In the present embodiment, for example, two straightening parts 35 are formed. That is, in the present embodiment, one of the straightening parts 35 is positioned in the upstream side of the swirling flow, and the other of the straightening parts 35 is positioned in the downstream side. The downstream end of the straightening part 35 positioned in the upstream side may be positioned in the upstream side of the swirling flow with respect to the upstream end of the straightening part 35 positioned in the downstream side, or alternatively may overlap in the circumference direction with the upstream end of the straightening part 35 positioned in the downstream side. Furthermore, each of the straightening parts 35 may project outward from the side surface part 26 by unfixed protruding extents at other positions than the upstream end, and the protruding extent may be increased or decreased at an arbitrary position. In an example, in the present embodiment, the downstream end of the straightening part 35 positioned in the downstream is formed so that the protruding extent from the side surface part 26 is gradually decreased toward the downstream side of the swirling flow.

The connection part 36 is formed so as to connect the downstream end side of one straightening part 35 and the upstream end side of another straightening part 35. The connection part 36 is formed so as to be continued smoothly from the straightening parts 35. In the present embodiment, the connection part 36 is formed so as to connect the downstream end side of the straightening part 35 positioned in the upstream side and the upstream end side of the straightening part 35 positioned in the downstream side. Thus, the connection part 36 is inclined to the side of the first centrifuge separator 4 from the downstream end side of the straightening part 35 positioned in the upstream side toward the upstream end side of the straightening part 35 positioned in the downstream side. That is, the inclined direction of the connection part 36 is different from the inclined directions of the respective straightening parts 35. Thus, the projection part 30 is formed so as to be curved at the position corresponding to the connection part 36.

The opposite-side projection surface 33 is formed basically in parallel with the projection surface 32. The opposite-side projection surface 33 may be formed so as to be inclined outward to the downstream side of the swirling flow at the position corresponding to the connection part 36. That is, the opposite-side projection surface 33 may be formed so as to be inclined to the downstream side of the swirling flow with respect to the normal direction of the side surface part at the position.

It is noted that the projection surface 32 and the opposite-side projection surface 33 are not always formed in planar shapes, but may be formed in, for example, curved shapes toward the first centrifuge separator 4 or toward the first dust-collecting part 5.

The top surface part 27 is formed along the direction intersecting with the axial direction of the exhaust pipe 20. The top surface part 27 further includes an opening part 37. The opening part 37 is formed on a portion of the top surface part 27 extended and enlarged more outward than the exhaust pipe 20. A plurality of the opening parts 37 are formed along the outer edge part of the top surface part 27, that is, along the outer circumference of the top surface part 27. In an example, each of the opening parts 37 is formed as a long circular-arc hole curved along the circumferential direction. Moreover, the opening parts 37 are disposed so as to be spaced away from one another in the circumferential direction. The opening parts 37 may be covered with, for example, a ventilation filter 38 serving as a filter.

The top surface part 27 may include a ventilation opening 40. The ventilation opening 40 is disposed at the center of the top surface part 27 facing the exhaust pipe 20. The ventilation opening 40 is formed as, for example, a circular hole. Also, the ventilation opening 40 may be covered with a compression filter 41 serving as a filter.

The top surface part 27 may further include a connection part 44 configured to detachably connect the exhaust pipe 20 and the enlarged part 24. In an example, the connection part may include an engagement part 45 which projects from the periphery of the ventilation opening 40 so as to be engaged with the end part of the exhaust pipe 20 in the side of the enlarged part 24, and a positioning part 46 which projects toward the first centrifuge separator 4 from a position inside the opening parts 37 on the top surface part 27 so as to position the exhaust pipe 20. It is noted that the connection part 44 is not an essential component.

The top surface part 27 further includes a wall part 48. The wall part 48 is formed so as to project in a rib shape from the top surface part 27 toward the first centrifuge separator 4. The wall part 48 is formed at least at a position corresponding to an outside position of the opening parts 37. Specifically, the wall part 48 is disposed at a position outside the opening parts 37 at least partially along the opening parts 37, and the end part of the wall part 48 may not reach to an end part of one of the opening parts 37, may reach substantially to an end part of one of the opening parts 37, or may extend over an end part of one of the opening parts 37. Moreover, the wall part 48 includes an end part **48*a* in the side of the first centrifuge separator 4, which projects toward the first centrifuge separator 4 over a position E which is the end part of the introduction port 3 in the side of the first dust-collecting part 5. Furthermore, the wall part 48 is set so that a protruding extent M toward the first centrifuge separator 4, of the end part 48*a* of the wall part 48 in the side of the first centrifuge separator 4 over the position E of the end part of the introduction port 3 in the side of the first dust-collecting part 5 is equal to or less than ¼ of a width W of the introduction port in the axis direction which is the longitudinal direction of the casing 10. It is noted that the top surface part 27 in the side of the exhaust pipe 20 may be positioned, for example, on the flush surface or substantially on the flush surface as the position E of the end part of the introduction port 3 in the side of the first dust-collecting part 5, may be positioned in the side of the first centrifuge separator 4, or may be positioned in the side of the first dust-collecting part 5. In an example, a pair of the wall parts 48 is formed. The wall parts 48 are disposed so as to be spaced away from each other at the position facing the introduction port 3 and the opposite position. Thus, the wall parts 48** are formed in curved circular-arc shapes when viewed in the axial direction.

The separator 11 includes a sectioning part 50. The sectioning part 50 is a part for separating the second dust-collecting part 7 from the casing 10. The sectioning part 50 includes, for example, a sealing member 51. The sealing member 51 seals the one end side of the casing 10 by being pressed against a step gap part 52 which is formed so as to be enlarged on the one end side of the casing 10, and separates, from the first centrifuge separator 4 and the first dust-collecting part 5, a portion positioned in the one end side of the casing 10 with respect to the step gap part 52 as the second dust-collecting part 7. Moreover, the sectioning part 50 may include a slope part 53 which is a dust introducing part allowing to introduce the dust and dirt centrifugally separated by the second centrifuge separators 6 into the second dust-collecting part 7.

The separator 11 further includes a separation main body 55 which covers a part in the one end side of the casing 10. The separation main body 55 is positioned outside the casing 10. The separation main body 55 houses an air introducing part not shown allowing to introduce the air discharged through the exhaust pipe 20, into the second centrifuge separators 6. The separation main body 55 further houses a plurality of cone parts 57 included in the second centrifuge separators 6. The cone parts 57 are formed each in a cone shape having a diameter decreasing toward the casing 10, and are disposed annularly. Each of the cone parts 57 is configured to separate dust and dirt by swirling the dust-containing air introduced inside, and discharge the separated dust and dirt through the slope part 53 into the second dust-collecting part 7. The separation main body 55 further houses an air discharge part not shown allowing to introduce air discharged from the second centrifuge separators 6 to the discharge port 8. In an example, a filter may be disposed to the air discharge part. The separation main body 55 includes the discharge port 8. The separation main body 55 may further include an attaching/detaching mechanism 58 configured to attach and detach the dust-collecting device 1 to and from the vacuum cleaner 2.

The vacuum cleaner 2 includes a main body 60 to which the dust-collecting device 1 is attached detachably. The vacuum cleaner 2 further includes an electric blower 61 serving as a suction source. The vacuum cleaner 2 further includes a control part not shown configured to control operations of the electric blower 61. The vacuum cleaner 2 further includes an operation part 63 through which operations to start and stop the electric blower 61 are input. In the present embodiment, the vacuum cleaner 2 is described by use of, as an example, a long stick type vacuum cleaner including an air path body 64 which is attachable to and detachable from the longitudinal main body 60. Alternatively, the vacuum cleaner 2 may be, for example, a canister type vacuum cleaner having the main body 60 capable of traveling on a floor surface, or may be a self-propelled type vacuum cleaner capable of traveling autonomously.

The operations in the above-described embodiment are described next.

When performing cleaning by use of the vacuum cleaner 2, a user attaches the dust-collecting device 1 to the main body 60, and operates the operation part 63 to make the electric blower 61 operate and suck dust and dirt together with air from a cleaning-object surface through the air path body 64 by utilizing the negative pressure generated by driving of the electric blower 61.

Dust-containing air is sucked through the air path body 64 via the main body 60 and thereafter from the introduction port 3 into the dust-collecting device 1. At this time, the dust-containing air is introduced through the introduction port 3 along the tangential direction of the inner surface 14 of the casing 10, and generates a swirling flow A between the insertion part 16 and the inner surface 14 of the casing 10.

The swirling flow A swirls between the exhaust pipe 20 and the inner surface 14 so that the first centrifuge separator 4 centrifugally separates dust and dirt, increases in flow velocity between the side surface part 26 of the enlarged part 24 and the inner surface 14, and flows into the first dust-collecting part 5 while swirling along the projection part 30. At this time, dust and dirt is pressed gradually downward by the swirling flow A flowing along the respective straightening parts 35.

The swirling flow A thereafter flows into the enlarged part 24, and apart of the swirling flow A passes through the opening parts 37 and circulates, and the remaining thereof passes through the ventilation opening 40. At this time, the dust and dirt accumulated in the first dust-collecting part 5 is pressed.

The dust-containing air which has passed through the exhaust pipe 20 is introduced from the air introducing part into the cone parts 57 of the second centrifuge separators 6, and is made to swirl in the cone parts 57 so that finer dust and dirt is separated and accumulated in the second dust-collecting part 7. The air after separation of dust and dirt is discharged via the air discharge part through the discharge port 8 to the outside of the dust-collecting device 1, and is further sucked into the electric blower 61 to cool the electric blower 61, and is thereafter exhausted.

In this case, when the dust and dirt accumulated in the first dust-collecting part 5 is increased, the swirling flow A hardly flows, and the dust-containing air is likely to flow toward the exhaust pipe 20 due to negative pressure. At this time, since the projection surface 32 includes the connection part 36 formed to connect the downstream end side of one straightening part 35 and the upstream end side of another straightening part 35, the connection part 36 suppresses the dust-containing air from flowing toward the exhaust pipe 20 due to the negative pressure, resulting in enabling to suppress dust and dirt from being stirred up.

Since the projection part 30 includes the intermittent part 31 between at least any two adjacent straightening parts 35, relatively-large dust and dirt is carried through the intermittent part 31 without being caught by the projection part 30, and is easily accumulated in the first dust-collecting part 5.

Especially, since the intermittent part 31 is formed at a position facing the introduction port 3 in the downstream side of the swirling flow A, relatively-large dust and dirt in the dust-containing air introduced through the introduction port 3 is immediately carried through the intermittent part 31 and is easily accumulated in the first dust-collecting part 5, thereby enabling to improve efficiency in dust-and-dirt separation.

Each of the straightening parts 35 is formed so that the upstream end thereof projects from the side surface part 26, gradually outward from the side of the introduction port 3 toward the downstream side of the swirling flow A. Thus, the dust and dirt carried along the swirling flow A into the first dust-collecting part 5 is hardly caught by the projection part 30.

Furthermore, the projection surface 32 is disposed at a position facing the introduction port 3 in the side of the first dust-collecting part 5 with respect to the introduction port 3, and thus hardly hinders the dust-containing air from being introduced through the introduction port 3.

The projection surface 32 is disposed so that the upstream end thereof is positioned within a range no greater in length than the half the circumference of the swirling flow A in the upstream side with respect to the introduction port 3. Thus, the dust-containing air introduced through the introduction port 3 is guided efficiently, thereby enabling to form the swirling flow A.

The opposite-side projection surface 33 of the projection part 30, which is opposite to the projection surface 32 and is positioned in the side of the first centrifuge separator 4, is formed so as to be inclined outward to the downstream side of the swirling flow A at the position corresponding to the connection part 36. Thus, the dust and dirt contained in the swirling flow A flowing along the opposite-side projection surface 33 is easily accumulated from the inclined position of the opposite-side projection surface 33 toward the first dust-collecting part 5.

Furthermore, on the top surface part 27 positioned in the side of the exhaust pipe 20, of the enlarged part 24 which is enlarged more outward than the cylindrical exhaust pipe 20 allowing to discharge the swirling flow A, the wall part 48 projects toward the first centrifuge separator 4 from the top surface part 27 of the enlarged part 24 in the side of the exhaust pipe 20, corresponding to the outside of the opening parts 37 formed at the positions enlarged more outward than the exhaust pipe 20, thereby enabling to strengthen the swirling flow A with a facing distance between the wall part 48 and the inner surface 14 of the casing 10, and further allowing the wall part 48 to introduce the air flow passing through the opening parts 37 to the outside of the exhaust pipe 20. Accordingly, this allows to improve efficiency in dust-and-dirt separation, while suppressing dust and dirt from adhering to the exhaust pipe 20.

The end part 48*a* of the wall part 48 in the side of the first centrifuge separator 4 projects toward the first centrifuge separator 4 over the position E of the end part of the introduction port 3 in the side of the first dust-collecting part 5. This allows to strengthen the swirling flow A while ensuring an enough facing distance between the wall part 48 and the inner surface 14 of the casing 10, thereby enabling to improve performance in dust-and-dirt separation.

The protruding extent M to the side of the first centrifuge separator 4 of the end part 48*a* of the wall part 48 in the side of the first centrifuge separator 4 over the position E of the end part of the introduction port 3 in the side of the first dust-collecting part 5 is set equal to or less than ¼ of the width W of the introduction port in the longitudinal direction of the casing 10. This allows to strengthen the swirling flow A while ensuring an enough facing distance between the wall part 48 and the inner surface 14 of the casing 10, and the wall part 48 hardly hinders air flow from being sucked into the exhaust pipe 20.

Second Embodiment

The second embodiment will be described next with reference to FIG. 9. It is noted that the same configurations and operations as those in the above-described embodiment are denoted by the same reference signs, and the descriptions thereof are omitted.

In the present embodiment, a flange part 68 is included, which projects from the outer edge part of the projection part 30 toward the first centrifuge separator 4.

Figure 9:
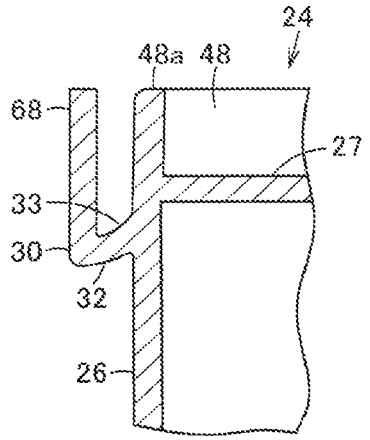
FIG. 9 is a sectional view partially illustrating a structure of a dust-collecting device of a second embodiment.
Figure 10:
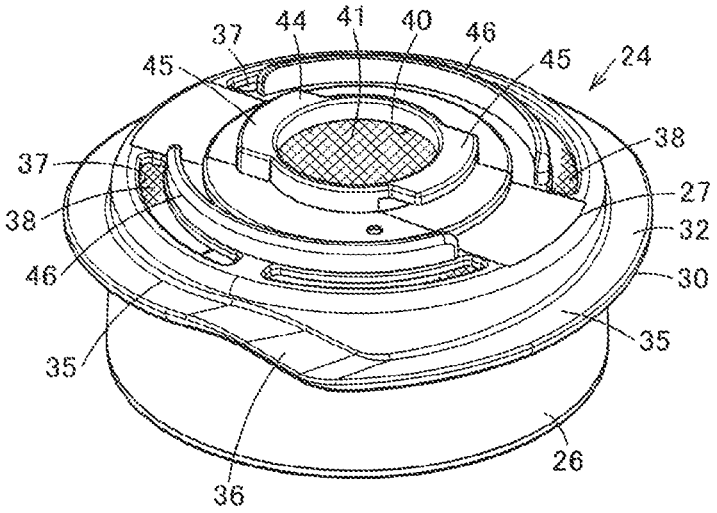
FIG. 10 is an oblique view partially illustrating a structure of a dust-collecting device of a third embodiment.
Figure 11:
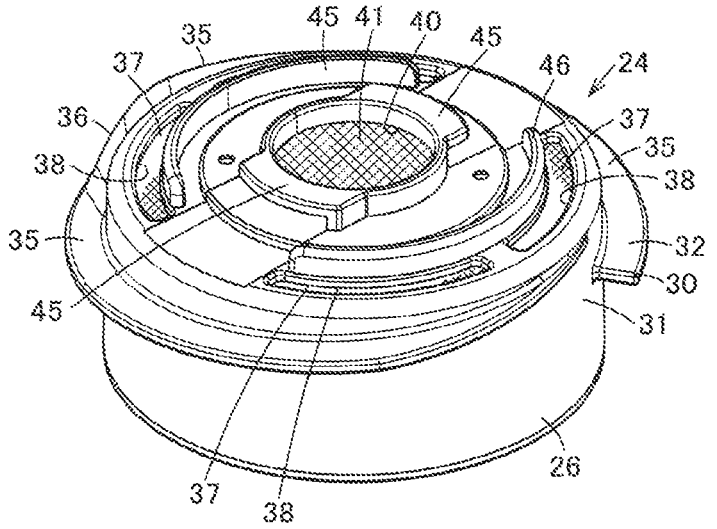
FIG. 11 is an oblique view partially illustrating the structure of the above dust-collecting device, viewed from an opposite direction to the one of FIG. 10.
Figure 12:
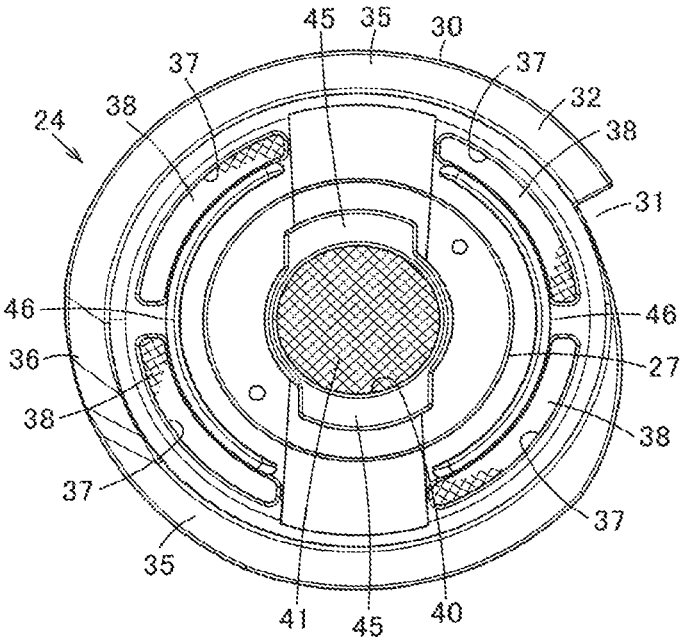
FIG. 12 is a plan view partially illustrating the structure of the above dust-collecting device.
Figure 13:
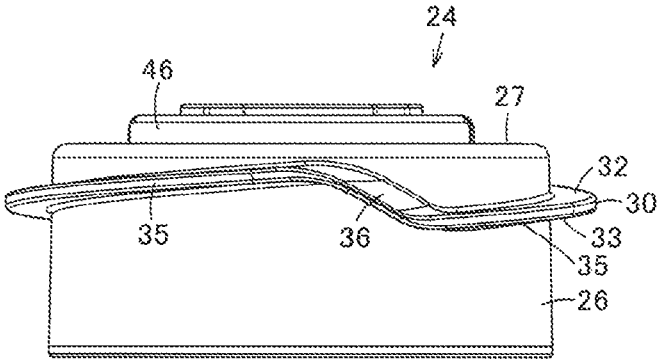
FIG. 13 is a side view partially illustrating the structure of the above dust-collecting device.

In an example, the edge part of the flange part 68 may be positioned on the flush surface or substantially on the flush surface as the end part 48*a* of the wall part 48, or may be positioned in the side of the first dust-collecting part 5, that is, in the lower side of FIG. 9, with respect to the end part 48*a* of the wall part 48. Moreover, the flange part 68 may be continuously formed at the position of the projection part 30 corresponding to the straightening parts 35 and the connection part 36.

As described above, even in the case where the flange part 68 is formed on the projection part 30, the same effects as the first embodiment described above are able to be exerted.

Third Embodiment

The third embodiment will be described next with reference to FIG. 10 to FIG. 13. It is noted that the same configurations and operations as those in the first embodiment described above are denoted by the same reference signs, and the descriptions thereof are omitted.

The present embodiment corresponds to the first embodiment described above without the wall part 48.

The straightening parts 35 are formed so as to project outward from the side surface part 26 by a substantially-constant protruding extent, except the upstream end.

As described above, even in the case of the configuration without the wall part 48, the projection surface 32 of the projection part 30 is able to exert the effects of suppressing dust and dirt from being stirred up from the first dust-collecting part 5.

It is noted that, in the respective embodiments described above, the projection part 30 may be formed continuously on the entire circumference. That is, the upstream end sides and the downstream end sides of the straightening parts 35 may be connected by the connection parts 36.

The casing 10 may include the bottom part 13 which is openable and closable so that the dust and dirt accumulated in the first dust-collecting part 5 and the second dust-collecting part 7 is discharged from the bottom.

While certain embodiments have been described, these embodiments have been presented by way of example only, and are not intended to limit the scope of the inventions. Indeed, the novel embodiments described herein may be embodied in a variety of other forms; furthermore, various omissions, substitutions, and changes in the form of the embodiments described herein may be made without departing from the spirit of the inventions. The accompanying claims and their equivalents are intended to cover such forms or modifications as would fall within the scope and spirit of the inventions.

The invention claimed is:

1. A vacuum cleaner, comprising:

a main body including an electric blower; and a dust-collecting device, wherein the dust-collecting device comprises:

a separator configured to centrifugally separate dust and dirt by swirling dust-containing air;

a dust-collecting part configured to accumulate the dust and the dirt separated by the separator;

a cylindrical casing having an introduction port allowing the dust-containing air to be introduced inside; and a structure disposed inside the casing so as to allow swirling flow of the dust-containing air to be formed between the structure and an inner surface of the casing, the structure including:

a cylindrical side surface part spaced away from and facing the inner surface of the casing;

a projection part projecting outward from the side surface part; and a projection surface of the projection part being a surface facing the dust-collecting part, and the projection surface including:

a plurality of straightening parts formed spirally toward the dust-collecting part, from an upstream side to a downstream side of the swirling flow; and a connection part formed so as to be attached to a downstream end side of one of the straightening parts, attached to an upstream end side of another one of the straightening parts, and connected to the cylindrical side surface part, and the dust-collecting device is attached to the main body and sucking the dust-containing air by driving the electric blower.

2. A dust-collecting device, comprising:

a separator configured to centrifugally separate dust and dirt by swirling dust-containing air;

a dust-collecting part configured to accumulate the dust and the dirt separated by the separator;

a cylindrical casing having an introduction port allowing the dust-containing air to be introduced inside; and a structure disposed inside the casing so as to allow swirling flow of the dust-containing air to be formed between the structure and an inner surface of the casing, the structure including:

a cylindrical side surface part spaced away from and facing the inner surface of the casing;

a projection part projecting outward from the side surface part; and a projection surface of the projection part being a surface facing the dust-collecting part, and the projection surface including:

a plurality of straightening parts formed spirally toward the dust-collecting part, from an upstream side to a downstream side of the swirling flow; and a connection part formed so as to be attached to a downstream end side of one of the straightening parts, attached to an upstream end side of another one of the straightening parts, and connected to the cylindrical side surface part.

3. The dust-collecting device according to claim 2, wherein the straightening parts are formed so that upstream ends project from the side surface part gradually outward from a side of the introduction port toward the downstream side of the swirling flow.

4. The dust-collecting device according to claim 2, wherein the projection surface is positioned in the side of the dust-collecting part with respect to the introduction port at a position facing the introduction port.

5. The dust-collecting device according to claim 2, wherein the projection surface is disposed so that an upstream end is positioned within a range no greater in length than a half a circumference of the swirling flow in the upstream side with respect to the introduction port.

6. The dust-collecting device according to claim 2, wherein the projection part is formed to have an opposite-side projection surface in a side of the separator opposite to the projection surface, and the opposite-side projection surface is formed so as to be inclined to the downstream side of the swirling flow outward at a position corresponding to the connection part.

7. The dust-collecting device according to claim 2, further comprising:

a flange part projecting from an outer edge part of the projection part to a side of the separator.

8. The dust-collecting device according to claim 2, wherein the structure includes a cylindrical ventilation part allowing to discharge the swirling flow, and the side surface part is formed in the side of the dust-collecting part with respect to the ventilation part.

9. The dust-collecting device according to claim 2, wherein the projection part includes an intermittent part between at least any adjacent two of the straightening parts.

10. The dust-collecting device according to claim 9, wherein the intermittent part is formed in the downstream side of the swirling flow with respect to a position facing the introduction port.

* * * * *